US010961807B2

(12) United States Patent
Foster et al.

(10) Patent No.: US 10,961,807 B2
(45) Date of Patent: Mar. 30, 2021

(54) LOSS CIRCULATION DRILLING PACKER

(71) Applicant: Saudi Arabian Oil Company, Dhahran (SA)

(72) Inventors: Herschel Foster, Dhahran (SA); Ossama R. Sehsah, Dhahran (SA); Mahmoud Alqurashi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 168 days.

(21) Appl. No.: 15/894,083

(22) Filed: Feb. 12, 2018

(65) Prior Publication Data

US 2019/0249512 A1 Aug. 15, 2019

(51) Int. Cl.

| | |
|---|---|
| ***E21B 33/12*** | (2006.01) |
| ***E21B 33/127*** | (2006.01) |
| ***E21B 21/00*** | (2006.01) |
| ***E21B 33/138*** | (2006.01) |
| ***E21B 43/10*** | (2006.01) |

(Continued)

(52) U.S. Cl.

CPC ..... *E21B 33/1277* (2013.01); *E21B 21/003* (2013.01); *E21B 23/06* (2013.01); *E21B 33/12* (2013.01); *E21B 33/127* (2013.01); *E21B 33/1208* (2013.01); *E21B 33/1216* (2013.01);

(Continued)

(58) Field of Classification Search

CPC ..... E21B 33/12–12955; E21B 17/10–17/12

See application file for complete search history.

(56) References Cited

U.S. PATENT DOCUMENTS 385,600 A * 7/1888 Durbrow ..... E21B 33/1277 277/331

3,425,489 A 2/1969 Brown (Continued)

FOREIGN PATENT DOCUMENTS

CN 107605423 A 1/2018

WO 03048508 A1 6/2003

(Continued)

OTHER PUBLICATIONS

International Search Report and Written Opinion for related PCT application PCT/US2019/017585 dated Apr. 29, 2019.

*Primary Examiner* — Steven A MacDonald

(74) *Attorney, Agent, or Firm* — Bracewell LLP; Constance G. Rhebergen; Linda L. Morgan

(57) ABSTRACT

Methods and systems for isolating a loss circulation zone of a subterranean formation includes lowering a drill string having a tubular member from a surface into a subterranean well and securing a packer assembly to the tubular member, the packer assembly having an inflatable packer unit and a protective sleeve. The protective sleeve is in an extended position and circumscribes the inflatable packer unit and the inflatable packer unit is in a deflated condition. A stabilizer body is secured to the tubular member downhole of the packer assembly. The stabilizer body is shaped to centralize the packer assembly and direct debris traveling uphole in a direction radially outward of the packer assembly. The protective sleeve is moved from the extended position to a retracted position. The inflatable packer unit is inflated to an inflated condition, forming a seal with an inner diameter surface of the subterranean uphole of the loss circulation zone.

16 Claims, 2 Drawing Sheets

(51) Int. Cl.
*E21B 23/06* (2006.01)
*E21B 17/10* (2006.01)

(52) U.S. Cl.
CPC ..... *E21B 33/138* (2013.01); *E21B 43/105* (2013.01); *E21B 17/1078* (2013.01)

(56) References Cited

U.S. PATENT DOCUMENTS 3,578,078 A * 5/1971 Shillander ..... E21B 33/128 166/152
5,121,797 A 6/1992 Decuir, Sr.
5,698,799 A * 12/1997 Lee, Jr. ..... E21B 33/1243 175/21
6,148,912 A * 11/2000 Ward ..... E21B 21/08 166/250.07
6,157,893 A 12/2000 Berger et al.
6,427,785 B2 * 8/2002 Ward ..... E21B 21/08 175/48
7,252,162 B2 * 8/2007 Akinlade ..... E21B 21/003 175/72
8,573,314 B2 11/2013 Corre et al.
2002/0011333 A1 * 1/2002 Ward ..... E21B 21/08 166/250.07
2005/0011678 A1 * 1/2005 Akinlade ..... E21B 21/003 175/72
2005/0199401 A1 9/2005 Patel et al.
2008/0223571 A1 * 9/2008 Murray ..... E21B 33/1208 166/118
2009/0090502 A1 * 4/2009 Lumbye ..... E21B 23/04 166/120
2013/0020097 A1 * 1/2013 Veneruso ..... E21B 33/127 166/386
2014/0008061 A1 * 1/2014 Corre ..... E21B 33/1208 166/264
2014/0131953 A1 * 5/2014 Lehr ..... E21B 33/126 277/323
2017/0101847 A1 * 4/2017 Hazel ..... E21B 17/05
2018/0245420 A1 * 8/2018 Ringgenberg ..... E21B 33/127
2019/0153852 A1 * 5/2019 Lallemand ..... E21B 47/12

FOREIGN PATENT DOCUMENTS

WO 2017027978 A1 2/2017
WO 2017052503 A1 3/2017

* cited by examiner

LOSS CIRCULATION DRILLING PACKER

BACKGROUND OF THE DISCLOSURE

1. Field of the Disclosure

The present disclosure relates to subterranean developments, and more specifically, the disclosure relates to open hole packers used during subterranean well drilling operations.

2. Description of the Related Art

During the drilling of subterranean wells, such as subterranean wells used in hydrocarbon development operations, drilling mud and other fluids can be pumped into the well. In certain drilling operations, the bore of the subterranean well can pass through a zone that has induced or natural fractures, are cavernous, or otherwise have a high permeability, and which is known as a loss circulation zone. In such a case, the drilling mud and other fluids that are pumped into the well can flow into the loss circulation zone. In instances where the bore of the subterranean well also passes through a high pressure production zone, the production fluids can also flow into the loss circulation zone, which is known as a cross-flow scenario.

SUMMARY OF THE DISCLOSURE

Packers that are used in uncased open hole regions of a wellbore, known as open hole packers, can be used to seal the wellbore. However, a packer could experience excessive abrasion and lose the ability to form a seal if the packer used as part of a drilling sting. Embodiments of this disclosure provide a packer assembly that includes a sliding protective sleeve that can cover the packer unit during drilling operations and move to uncover the packer unit when the packer unit is to be inflated. A stabilizer adjacent to the packer assembly can centralize the packer assembly and direct debris that is traveling out of the wellbore towards the sidewall of the bore and radially outward of the packer assembly.

Systems and methods of this disclosure can be used to seal within a wellbore and isolate a loss circulation zone in order to treat the loss circulation zone. Embodiments of this disclosure allow for the loss circulation zone to be treated without having to pull the drill string out of the wellbore. The equipment needed to isolate the loss circulation zone is part of the drill string and no additional specialty equipment is required.

In an embodiment of this disclosure, a method for isolating a loss circulation zone of a subterranean formation includes lowering a drill string having a tubular member from a surface into a subterranean well and drilling a wellbore of the subterranean well with a bottom hole assembly located at a downhole end of the tubular member. A packer assembly is secured to the tubular member, the packer assembly having an inflatable packer unit and a protective sleeve, where the protective sleeve is in an extended position and circumscribes the inflatable packer unit and the inflatable packer unit is in a deflated condition. A stabilizer body is secured to the tubular member downhole of the packer assembly, the stabilizer body shaped to centralize the packer assembly and direct debris traveling uphole in a direction radially outward of the packer assembly. The protective sleeve is moved from the extended position to a retracted position where the protective sleeve is axially adjacent to the inflatable packer unit. The inflatable packer unit is inflated so that the inflatable packer unit is in an inflated condition, forming a seal with an inner diameter surface of the subterranean well at a location within the subterranean well that is uphole of the loss circulation zone.

In alternate embodiments, the packer assembly can be secured to the tubular member at a location spaced axial apart from the bottom hole assembly. The inflatable packer unit can have two or more separate packer members and inflating the inflatable packer unit can include inflating each of the two or more separate packer members. Moving the protective sleeve from the extended position to the retracted position can include pumping a radio frequency identification device into the subterranean well. Forming the seal with the inner diameter surface of the subterranean well can include forming the seal with the inner diameter surface of an uncased open wellbore of the subterranean well. After inflating the inflatable packer unit, a loss circulation treatment can be pumped through the tubular member and into the wellbore of the subterranean well for injection into the loss circulation zone. The inflatable packer unit can be deflated, the protective sleeve can be moved to the extended position, and drilling of the wellbore of the subterranean well can be continued.

In alternate embodiments of this disclosure, a method for isolating a loss circulation zone of a subterranean formation includes lowering a drill string having a tubular member from a surface into a subterranean well and rotating the tubular member to drill a wellbore of the subterranean well with a bottom hole assembly located at a downhole end of the tubular member. A packer assembly is secured to the tubular member axially uphole of the bottom hole assembly, the packer assembly having three separate packer members and a protective sleeve, where the protective sleeve is in an extended position and circumscribes the three separate packer members and each of the three separate packer members is in a deflated condition. A stabilizer body is secured to the tubular member downhole of the packer assembly, the stabilizer body shaped to centralize the packer assembly and direct debris traveling uphole in a direction radially outward of the packer assembly. The protective sleeve is moved from the extended position to a retracted position where the protective sleeve is axially adjacent to the three separate packer members. The three separate packer members are inflated so that one or more of the three separate packer members is in an inflated condition and forms a seal with inner diameter surface of an uncased open hole wellbore the subterranean well at a location within the subterranean well that is uphole of the loss circulation zone.

In alternate embodiments, moving the protective sleeve from the extended position to the retracted position can include pumping a radio frequency identification device into the subterranean well. After inflating the three separate packer members, a loss circulation treatment can be pumped through the tubular member and into the wellbore of the subterranean well for injection into the loss circulation zone. The three separate packer members can be deflated, the protective sleeve can be moved to the extended position, and the tubular member can be rotated to continue to drill the wellbore of the subterranean well.

In other alternate embodiments, a system for isolating a loss circulation zone of a subterranean formation includes a drill string having a tubular member extending from a surface into a subterranean well, the drill string operable to drill a wellbore of the subterranean well with a bottom hole assembly located at a downhole end of the tubular member. A packer assembly is secured to the tubular member, the packer assembly having an inflatable packer unit and a protective sleeve, where the protective sleeve is moveable between an extended position where the protective sleeve circumscribes the inflatable packer unit and the inflatable packer unit is in a deflated condition, and a retracted position where the protective sleeve is axially adjacent to the inflatable packer unit. A stabilizer body is secured to the tubular member downhole of the packer assembly, the stabilizer body shaped to centralize the packer assembly and direct debris traveling uphole in a direction radially outward of the packer assembly. The inflatable packer unit is sized to seal with an inner diameter surface of the subterranean well at a location within the subterranean well that is uphole of the loss circulation zone when the inflatable packer unit is in an inflated condition.

In alternate embodiments, the packer assembly can be secured to the tubular member at a location spaced axial apart from the bottom hole assembly. The inflatable packer unit can have two or more separate packer members. A radio frequency identification device can be operable to be pumped into the subterranean well to signal the protective sleeve to move from the extended position and the retracted position. The radio frequency identification device can alternately be operable to be pumped into the subterranean well to signal the protective sleeve to move from the retracted position and the extended position. The inflatable packer unit cam be located at an elevation of an uncased open wellbore of the subterranean well. The drill string can have a fluid flow path operable to deliver a loss circulation treatment through the tubular member and into the wellbore of the subterranean well for injection into the loss circulation zone.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
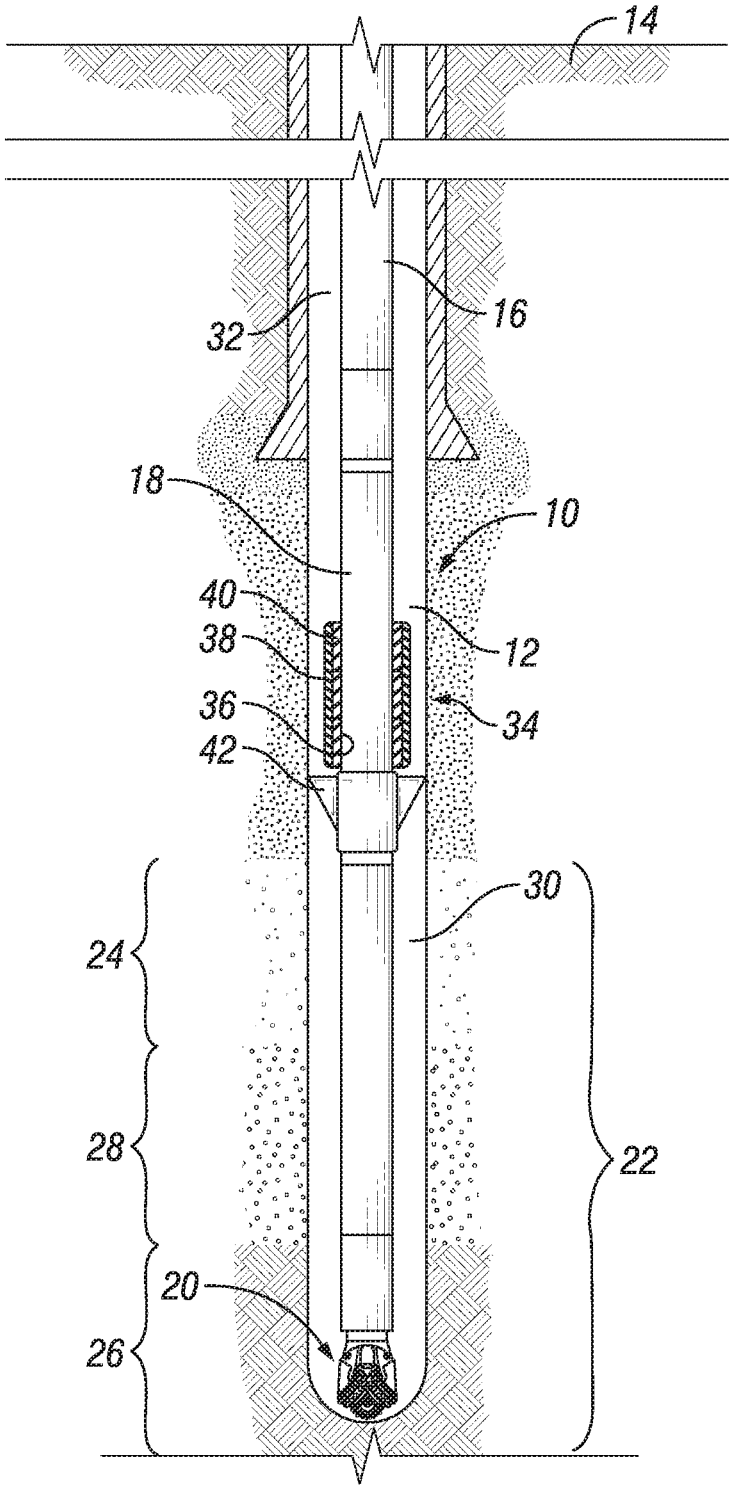
FIG. 1 is a section view of a subterranean well with a packer assembly in accordance with an embodiment of this disclosure, shown with the protective sleeve in an extended position and the packer unit in a deflated condition.

Looking at FIG. 1, subterranean well 10 can have wellbore 12 that extends to an earth's surface 14. Subterranean well 10 can be an offshore well or a land based well and can be used for producing hydrocarbons from subterranean hydrocarbon reservoirs. Drill string 16 can be lowered into and located within wellbore 12. Drill string 16 can include tubular member 18 and bottom hole assembly 20. Tubular member 18 can extend from surface 14 into subterranean well 10. Bottom hole assembly 20 can include, for example, drill collars, stabilizers, reamers, shocks, a bit sub and the drill bit. Drill string 16 can be used to drill wellbore 12. In certain embodiments, tubular member 18 is rotated to rotate the bit to drill wellbore 12.

Wellbore 12 can be drilled from surface 14 and into reservoir 22. Reservoir 22 can be a layers reservoir that includes upper production zone 24 and lower production zone 26. Upper production zone 24 and lower production zone 26 contain hydrocarbon gas, oil, or a combination of gas and oil. Upper production zone 24 and lower production zone 26 can be high pressure production zones. As an example, a high pressure well in accordance with an embodiment of this disclosure can be a well with reservoir pressures in excess of 5000 psi.

Wellbore 12 can also pass through loss circulation zone 28. In the example embodiments of FIGS. 1-2, loss circulation zone 28 is a layer of reservoir 22 that is located between upper production zone 24 and lower production zone 26. In alternate embodiments, loss circulation zone 28 can be uphole of upper production zone 24 or downhole of lower production zone 26.

Reservoir 22 can be at an elevation of uncased open hole bore 30 of subterranean well 10. Drill string 16 can pass though cased bore 32 of subterranean well 10 in order to reach uncased open hole bore 30.

Packer assembly 34 can be secured to tubular member 18 and can be used to isolate the portion of wellbore 12 that uphole of packer assembly 34 from loss circulation zone 28.

Packer assembly 34 circumscribes tubular member 18 and can seal around tubular member 18. Packer assembly 34 is secured to tubular member 18 at a location spaced axial apart from bottom hole assembly 20. In order to determine appropriate placement of packer assembly 34 along tubular member 18, a gamma ray tool can be used for geo-correlation while drilling.

Figure 2:
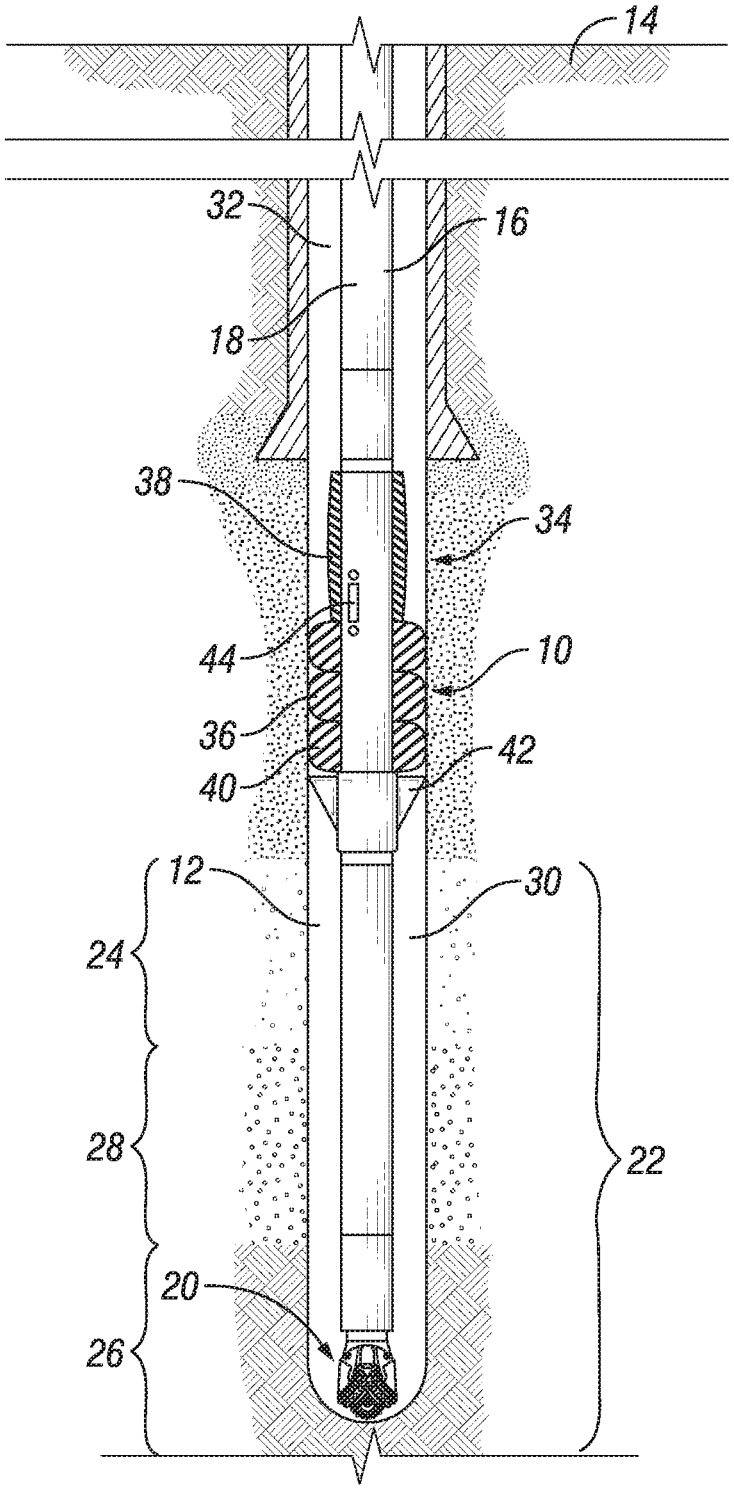
FIG. 2 is a section view of a subterranean well with the packer assembly of FIG. 1, shown with the protective sleeve in a retracted position and the packer unit in an inflated condition.

Looking at FIGS. 1-2, packer assembly 34 includes inflatable packer unit 36 and protective sleeve 38. Inflatable packer unit 36 has two or more separate packer members 40. Each of the separate packer members 40 can be sized so that when each separate packer member 40 is inflated to an inflated condition, as shown in FIG. 2, inflatable packer unit 36 seals with an inner diameter surface of wellbore 12 of subterranean well 10.

Having two or more separate packer members 40 that can be inflated as a group can ensure a reliable seal by inflatable packer unit 36, even if there is a large differential pressure rating, such as a differential pressure of up to 10,000 psi and the inflatable packer unit 36 is being exposed to a high temperate within wellbore 12, such as temperatures up to 300 degrees Fahrenheit. In the example embodiments of FIGS. 1-2, inflatable packer unit 36 is shown with three separate packer members 40. In alternate embodiments, inflatable packer unit 36 can have two or can have four or more separate packer members 40. In each embodiment, when inflating the packer unit, each of the separate packer members 40 are inflated.

Looking at FIG. 1, when lowering drill string 16 into wellbore 12 of subterranean well 10, such as during drilling operations, or when inflatable packer unit 36 is otherwise not required for wellbore isolation purposes, inflatable packer unit 36 can be in a deflated condition. In the deflated condition, protective sleeve 38 can be used to protect inflatable packer unit 36 from wear and abrasion that can be encountered within wellbore 12, such as during drilling operations. Excessive wear and abrasion to inflatable packer unit 36 can cause inflatable packer unit 36 to lose the ability to form a reliable seal with the inner diameter surface of wellbore 12 of subterranean well 10.

When protecting inflatable packer unit 36, protective sleeve 38 is in an extended position and circumscribes inflatable packer unit 36 and inflatable packer unit 36 is in the deflated condition, as shown in FIG. 1. In the extended position, protective sleeve 38 can circumscribe each of the separate packer member 40 so that every separate packer member 40 is protected from wear and abrasion.

Stabilizer body 42 is also used to protect inflatable packer unit 36. Stabilizer body 42 is secured to tubular member 18 downhole of packer assembly 34. Stabilizer body 42 is shaped to centralize packer assembly 34 and direct debris traveling uphole in a direction radially outward of the packer assembly 34. The inflation of inflatable packer unit 36 may be negatively affected by any eccentricity of drill string 16. Stabilizer body 42 will centralize inflatable packer unit 36 and aid in proper inflation of inflatable packer unit 36. Stabilizer body 42 can also more generally centralize tubular member 18 and bottom hole assembly 20. In addition, stabilizer body 42 time will direct debris traveling uphole within wellbore 12 in a direction radially outward of in packer assembly 34 so that such debris does not hit packer assembly 34, causing additional wear and abrasion to packer assembly 34.

Looking at FIG. 2, with packer assembly 34 at a location within subterranean well 10 that is uphole of loss circulation zone 28, protective sleeve 38 can be moved from the extended position. In the retracted position protective sleeve 36 is axially adjacent to inflatable packer unit 36 so that each of the separate packer members 40 can fully inflate without protective sleeve 38 interfering with such inflation.

Smart technology can be used to move protective sleeve 38 between the extended position and the retracted position. As an example, radio frequency identification device 44 can be pumped into subterranean well 10. The radio frequency identification device 44 can be detectable by an actuation system of packer assembly 34 to move protective sleeve 38 between the extended position and the retracted position. A same or another radio frequency identification device 44 can be used to signal the actuation system of packer assembly 34 to inflate and deflate inflatable packer unit 36. The actuation system can, for example, include a tool that opens a small valve to allow the internal pressure within tubular member 18 or wellbore 12 to cause protective sleeve 38 to move between the extended position and the retracted position or to inflate or deflate packer assembly 34, as applicable.

After protective sleeve 38 is moved to the retracted position, inflatable packer unit 36 can be inflated so that inflatable packer unit 36 is in an inflated condition. In the inflated condition, inflatable packer unit 36 forms a seal with an inner diameter surface of wellbore 12 of subterranean well 10 at a location within subterranean well 10 that is uphole of loss circulation zone 28. In the example embodiments shown, inflatable packer unit 36 forms a seal with the inner diameter surface of a portion of wellbore 23 that is uncased open hole bore 30. In alternate embodiments, inflatable packer unit 36 can form a seal with the inner diameter surface of a portion of wellbore 23 that is cased 32.

With the inflatable packer unit 36 isolating loss circulation zone 28 from wellbore 12 uphole of packer assembly 34, loss circulation zone 28 can be treated, for example by pumping a loss circulation treatment through tubular member 18 and into wellbore 12 downhole of packer assembly 34 for injection into loss circulation zone 28.

After treating loss circulation zone 28, when the loss of fluid into loss circulation zone 28 is controlled and normal wellbore pressure is detected during the pumping process, inflatable packer unit 36 can be deflated and protective sleeve 38 can be moved to the extended position, so that packer assembly 34 is in the configuration of FIG. 1. The drilling of wellbore 12 with bottom hole assembly 20 can then be resumed.

In an example of operation and looking at FIG. 1, in order to isolate loss circulation zone 28, a packer assembly 34 can be secured to a tubular member 18 of drill string 16 that is used to drill wellbore 12 of subterranean well 10. Packer assembly 34 when being lowered into wellbore 12, inflatable packer unit 36 of packer assembly 34 is in a deflated condition and protective sleeve 38 is in an extended position so that protective sleeve 38 circumscribes inflatable packer unit 36. Stabilizer body 42 is also secured to tubular member 18, downhole of packer assembly 34. Stabilizer body 42 is shaped to centralize packer assembly 34 and direct debris traveling uphole in a direction radially outward of packer assembly 34.

Protective sleeve 38 can be moved to the retracted position where protective sleeve 38 is axially adjacent to inflatable packer unit 36. Inflatable packer unit 36 can then be inflated so that inflatable packer unit 36 is in an inflated condition, forming a seal with an inner diameter surface of subterranean well 10 at a location within subterranean well 10 that is uphole of loss circulation zone 28.

With inflatable packer unit 36 in the inflated condition, loss circulation zone 28 can be treated, such as by pumping a loss circulation treatment through tubular member 18 and into wellbore 12 of subterranean well 10 for injection into loss circulation zone 28. After loss circulation zone 28 has been healed, inflatable packer unit 36 can be deflated so that inflatable packer unit 36 is in a deflated condition, protective sleeve 38 can be moved to the extended position to circumscribe inflatable packer unit 36. Drilling of wellbore 12 can then be continued.

Embodiments described in this disclosure therefore provide systems and methods that avoid wellbore stability issues without having to sidetrack the wellbore. Previously drilled reservoirs through which the wellbore passes can be protected from loss circulation and cross-flow situations. Well control issues associated with encountering a loss of circulation are minimized. As an example, encountering a loss circulation zone can result in uncontrollable losses and cross-flow with a nearby high pressure zone and can result in a breakdown of the mud system which can lead to a stuck pipe and a sidetrack. Embodiments of this disclosure mitigate the risk of such events because the losses can be controlled by systems and methods described herein if and as they occur. Embodiments of this disclosure can further act as a barrier to isolate the well downhole of the packer assembly, which can protect equipment and personnel at the surface. Further, systems described herein are rigorous enough to be picked up with the drilling assembly to perform any float and shoe track cleanout and then can continue with the drilling operation, eliminating the need for a separate clean out run in the well.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method for isolating a loss circulation zone of a subterranean formation, the method including:

lowering a drill string having a tubular member from a surface into a subterranean well and drilling a wellbore of the subterranean well with a bottom hole assembly located at a downhole end of the tubular member;

securing a single packer assembly to the tubular member, the single packer assembly having an inflatable packer unit and a protective sleeve, where the protective sleeve is in an extended position and circumscribes the inflatable packer unit and the inflatable packer unit is in a deflated condition;

securing a stabilizer body to the tubular member downhole of the single packer assembly, the stabilizer body shaped to centralize the single packer assembly and having an outer diameter that increases in an uphole direction so that the largest outer diameter of the stabilizer body is at the terminal uphole end of the stabilizer body so that debris traveling uphole is directed in a direction radially outward of the single packer assembly by the stabilizer body;

moving the protective sleeve from the extended position to a retracted position where the protective sleeve is axially adjacent to the inflatable packer unit; and inflating the inflatable packer unit so that the inflatable packer unit is in an inflated condition, forming a seal with an inner diameter surface of the subterranean well at a location within the subterranean well that is uphole of the loss circulation zone;

where the inflatable packer unit has two or more separate packer members that are part of the single packer assembly, and where inflating the inflatable packer unit includes selectively inflating the separate packer members separately.

2. The method of claim 1 where the single packer assembly is secured to the tubular member at a location spaced axial apart from the bottom hole assembly.

3. The method of claim 1, where moving the protective sleeve from the extended position to the retracted position includes pumping a radio frequency identification device into the subterranean well.

4. The method of claim 1, where forming the seal with the inner diameter surface of the subterranean well includes forming the seal with the inner diameter surface of an uncased open wellbore of the subterranean well.

5. The method of claim 1, further including after inflating the inflatable packer unit, pumping a loss circulation treatment through the tubular member and into the wellbore of the subterranean well for injection into the loss circulation zone.

6. The method of claim 1, further including deflating the inflatable packer unit, moving the protective sleeve to the extended position, and then continuing to drill the wellbore of the subterranean well.

7. A method for isolating a loss circulation zone of a subterranean formation, the method including:

lowering a drill string having a tubular member from a surface into a subterranean well and rotating the tubular member to drill a wellbore of the subterranean well with a bottom hole assembly located at a downhole end of the tubular member;

securing a single packer assembly to the tubular member axially uphole of the bottom hole assembly, the single packer assembly having three separate packer members that are part of the single packer assembly, and a protective sleeve, where the protective sleeve is in an extended position and circumscribes the three separate packer members and each of the three separate packer members is in a deflated condition;

securing a stabilizer body to the tubular member downhole of the single packer assembly, the stabilizer body shaped to centralize the single packer assembly and having an outer diameter that increases in an uphole direction so that the largest outer diameter of the stabilizer body is at an the terminal uphole end of the stabilizer body so that debris traveling uphole is directed in a direction radially outward of the single packer assembly by the packer body;

moving the protective sleeve from the extended position to a retracted position where the protective sleeve is axially adjacent to the three separate packer members; and selectively inflating the three separate packer members separately so that one or more of the three separate packer members is in an inflated condition and forms a seal with inner diameter surface of an uncased open hole wellbore of the subterranean well at a location within the subterranean well that is uphole of the loss circulation zone.

8. The method of claim 7, where moving the protective sleeve from the extended position to the retracted position includes pumping a radio frequency identification device into the subterranean well.

9. The method of claim 7, further including after inflating the three separate packer members, pumping a loss circulation treatment through the tubular member and into the wellbore of the subterranean well for injection into the loss circulation zone.

10. The method of claim 7, further including deflating the three separate packer members, moving the protective sleeve to the extended position, and then rotating the tubular member to continue to drill the wellbore of the subterranean well.

11. A system for isolating a loss circulation zone of a subterranean formation, the method including:

a drill string having a tubular member extending from a surface into a subterranean well, the drill string operable to drill a wellbore of the subterranean well with a bottom hole assembly located at a downhole end of the tubular member;

a single packer assembly secured to the tubular member, the single packer assembly having an inflatable packer unit and a protective sleeve, where the protective sleeve is moveable between an extended position where the protective sleeve circumscribes the inflatable packer unit and the inflatable packer unit is in a deflated condition, and a retracted position where the protective sleeve is axially adjacent to the inflatable packer unit;

a stabilizer body secured to the tubular member downhole of the single packer assembly, the stabilizer body shaped to centralize the single packer assembly and having an outer diameter that increases in an uphole direction so that the largest outer diameter of the stabilizer body is at an the terminal uphole end of the stabilizer body so that debris traveling uphole is directed in a direction radially outward of the single packer assembly by the stabilizer body; where the inflatable packer unit is sized to seal with an inner diameter surface of the subterranean well at a location within the subterranean well that is uphole of the loss circulation zone when the inflatable packer unit is in an inflated condition; and where the inflatable packer unit has two or more separate packer members that are part of the single packer assembly, each of the separate packer members operable to be selectively inflated separately.

12. The system of claim 11 where the single packer assembly is secured to the tubular member at a location spaced axial apart from the bottom hole assembly.

13. The system of claim 11, further including a radio frequency identification device operable to be pumped into the subterranean well to signal the protective sleeve to move from the extended position and the retracted position.

14. The system of claim 11, further including a radio frequency identification device operable to be pumped into the subterranean well to signal the protective sleeve to move from the retracted position and the extended position.

15. The system of claim 11, where the inflatable packer unit is located at an elevation of an uncased open wellbore of the subterranean well.

16. The system of claim 11, where the drill string has a fluid flow path operable to deliver a loss circulation treatment through the tubular member and into the wellbore of the subterranean well for injection into the loss circulation zone.

* * * * *